US008135334B2

(12) United States Patent
Dennisson et al.

(10) Patent No.: US 8,135,334 B2
(45) **Date of Patent: *Mar. 13, 2012**

(54) METHODS, SYSTEMS, AND COMPUTER PROGRAM PRODUCTS FOR TRANSMITTING STREAMING MEDIA TO A MOBILE TERMINAL USING THE BANDWIDTH ASSOCIATED WITH A WIRELESS NETWORK

(75) Inventors: Joseph Patrick Dennisson, Atlanta, GA (US); Timothy Hope, Loganville, GA (US); Ron Perrella, Atlanta, GA (US); Ryan Lee Schaub, Snellville, GA (US); John Blake Slemmer, Norcross, GA (US)

(73) Assignee: AT&T Intellectual Property I, LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,301

(22) Filed: Mar. 31, 2011

(65) Prior Publication Data

US 2011/0177776 A1 Jul. 21, 2011

Related U.S. Application Data

(63) Continuation of application No. 12/637,390, filed on Dec. 14, 2009, now Pat. No. 7,929,904, which is a continuation of application No. 10/732,784, filed on Dec. 10, 2003, now Pat. No. 7,650,111.

(51) Int. Cl.
*H04H 40/00* (2008.01)

(52) U.S. Cl. ..... 455/3.06; 455/3.01; 455/414.1; 725/68

(58) Field of Classification Search ..... 455/3.01–3.06, 455/414.1–414.3
See application file for complete search history.

(56) References Cited

U.S. PATENT DOCUMENTS

| | | | | |
|---|---|---|---|---|
| 4,130,801 | A * | 12/1978 | Prygoff | 455/3.02 |
| 5,404,567 | A | 4/1995 | DePietro et al. | |
| 5,594,779 | A | 1/1997 | Goodman | |
| 6,108,365 | A | 8/2000 | Rubin et al. | |
| 6,389,290 | B1 | 5/2002 | Kikinis et al. | |
| 6,507,727 | B1 | 1/2003 | Henrick | |
| 6,567,984 | B1 | 5/2003 | Allport | |
| 6,594,498 | B1 | 7/2003 | McKenna et al. | |
| 6,687,486 | B2 | 2/2004 | Grzeczkowski | |
| 6,725,022 | B1 | 4/2004 | Clayton et al. | |
| 6,735,435 | B2 | 5/2004 | Newell et al. | |
| 6,741,834 | B1 | 5/2004 | Godwin | |
| 6,751,673 | B2 * | 6/2004 | Shaw | 709/231 |
| 6,785,551 | B1 | 8/2004 | Richard | |
| 6,792,615 | B1 | 9/2004 | Rowe et al. | |
| 6,925,285 | B2 | 8/2005 | Kim | |
| 6,952,558 | B2 * | 10/2005 | Hardacker | 455/3.06 |
| 6,957,041 | B2 | 10/2005 | Christensen et al. | |
| 6,978,116 | B2 | 12/2005 | Burr et al. | |
| 7,050,870 | B2 | 5/2006 | Sueyoshi et al. | |
| 7,123,875 | B1 * | 10/2006 | Marko et al. | 455/3.02 |
| 7,233,781 | B2 | 6/2007 | Hunter et al. | |
| 7,289,793 | B2 | 10/2007 | Norwood et al. | |
| 7,379,760 | B2 | 5/2008 | Ishii | |
| 7,409,456 | B2 * | 8/2008 | Sitaraman | 709/231 |

(Continued)

*Primary Examiner* — Sharad Rampuria
(74) *Attorney, Agent, or Firm* — Moazzam & Associates, LLC

(57) ABSTRACT

A communication network is operated by obtaining a subscription at a wireless network from at least one device for a rebroadcast of streaming media and rebroadcasting the streaming media to the at least one device using the wireless network responsive to obtaining the subscription.

18 Claims, 3 Drawing Sheets

U.S. PATENT DOCUMENTS

| | | | | |
|---|---|---|---|---|
| 7,606,327 | B2 | 10/2009 | Walker et al. | |
| 7,643,788 | B2 * | 1/2010 | Habaguchi et al. | 455/3.03 |
| 7,653,342 | B2 | 1/2010 | Nichols et al. | |
| 7,684,826 | B2 | 3/2010 | Champion et al. | |
| 7,720,435 | B2 | 5/2010 | Bettinger | |
| 7,787,818 | B2 | 8/2010 | Shapiro et al. | |
| 2001/0053700 | A1 | 12/2001 | Sibley | |
| 2002/0049037 | A1 | 4/2002 | Christensen et al. | |
| 2002/0092025 | A1 | 7/2002 | Klumpp | |
| 2002/0115454 | A1 | 8/2002 | Hardacker | |
| 2003/0003899 | A1 | 1/2003 | Tashiro et al. | |
| 2003/0050062 | A1 | 3/2003 | Chent et al. | |
| 2003/0070174 | A1 * | 4/2003 | Solomon | 725/98 |
| 2003/0093790 | A1 * | 5/2003 | Logan et al. | 725/38 |
| 2003/0162495 | A1 | 8/2003 | Yonemoto et al. | |
| 2003/0181160 | A1 | 9/2003 | Hirsch | |
| 2003/0224781 | A1 | 12/2003 | Milford et al. | |
| 2004/0057420 | A1 | 3/2004 | Curcio et al. | |
| 2004/0171381 | A1 | 9/2004 | Inselberg | |
| 2004/0192198 | A1 | 9/2004 | Montebruno et al. | |
| 2004/0266336 | A1 * | 12/2004 | Patsiokas et al. | 455/3.04 |
| 2005/0014489 | A1 | 1/2005 | Zhigang | |
| 2005/0090275 | A1 | 4/2005 | Wang | |
| 2005/0136897 | A1 | 6/2005 | Praveenkumar et al. | |
| 2005/0169255 | A1 | 8/2005 | Shimomura et al. | |
| 2006/0014490 | A1 | 1/2006 | Kopra et al. | |
| 2006/0282847 | A1 | 12/2006 | Gupte | |
| 2007/0054614 | A1 | 3/2007 | Walker et al. | |
| 2007/0243821 | A1 | 10/2007 | Hundscheidt et al. | |
| 2008/0254739 | A1 * | 10/2008 | Kidd et al. | 455/3.01 |

* cited by examiner

METHODS, SYSTEMS, AND COMPUTER PROGRAM PRODUCTS FOR TRANSMITTING STREAMING MEDIA TO A MOBILE TERMINAL USING THE BANDWIDTH ASSOCIATED WITH A WIRELESS NETWORK

CROSS REFERENCE TO RELATED APPLICATIONS

This application is a continuation of U.S. patent application Ser. No. 12/637,390, filed Dec. 14, 2009, now U.S. Pat. No. 7,929,904, which is a continuation of U.S. patent application Ser. No. 10/732,784, filed Dec. 10, 2003, now U.S. Pat. No. 7,650,111, the disclosures of which are hereby incorporated herein by reference.

FIELD OF THE INVENTION

The present invention relates to communication networks, and, more particularly, to wireless communication networks.

BACKGROUND OF THE INVENTION

The Internet has expanded the accessibility of local radio and/or television stations to virtually any location in which a listener/viewer can establish an Internet connection. This has changed the way people listen to radio and/or watch television, particular for events, such as sporting events. The Internet has made it possible for a sports fan, for example, to listen to or perhaps even view, a game involving his or her favorite team live even if the fan is not within the physical broadcast range of a radio or television station's transmitter. Unfortunately, it may be difficult to take advantage of such a broadcast over the Internet when away from home or other location having Internet access. Moreover, viewing or listening to such real time events over a low bandwidth Internet connection, such as a dial-up connection, may provide an unsatisfactory viewing and/or listening experience.

SUMMARY OF THE INVENTION

According to some embodiments, a communication network is operated by obtaining a subscription at a wireless network from at least one device for a rebroadcast of streaming media and rebroadcasting the streaming media to the at least one device using the wireless network responsive to obtaining the subscription.

In other embodiments, the method further comprises obtaining authorization from a media broadcaster that provides the streaming media to rebroadcast the streaming media prior to rebroadcasting the streaming media.

In still other embodiments, the streaming media comprises audio and/or video content.

In still other embodiments, rebroadcasting the streaming media comprises rebroadcasting the streaming media to the at least one device using bandwidth associated with the wireless network and using third generation (3G) wireless communication technology.

In still other embodiments, rebroadcasting the streaming media comprises rebroadcasting the streaming media to the at least one device using bandwidth associated with the wireless network and using wideband code division multiple access (WCDMA) technology, universal mobile telecommunications system (UMTS) technology, and/or enhanced data GSM (global system for mobile communications) environment technology.

In still other embodiments, the wireless network comprises a Wi-Fi communication network.

In still other embodiments, rebroadcasting the streaming media comprises rebroadcasting the streaming media to the at least one device using bandwidth associated with the wireless network and using IEEE 802.11b technology.

In still other embodiments, the streaming media further comprises text.

In still other embodiments, the streaming media comprises content from a television broadcast, an amplitude modulation (AM) radio broadcast and/or a frequency modulation (FM) radio broadcast.

In still other embodiments, the streaming media comprises content from a video conference and/or a gaming application.

In still other embodiments, rebroadcasting the streaming media comprises rebroadcasting the streaming media to the at least one device using bandwidth associated with the wireless network while moving the at least one device between cells associated with the wireless network.

In further embodiments, a communication system comprises a wireless network that is configured to obtain a subscription from at least one device for a rebroadcast of streaming media and to rebroadcast the streaming media to the at least one device responsive to obtaining the subscription.

In still further embodiments, the wireless network is further configured to obtain authorization from a media broadcaster that provides the streaming media to rebroadcast the streaming media prior to rebroadcasting the streaming media.

In still further embodiments, the streaming media comprises audio and/or video content.

In still further embodiments, the wireless network is further configured to rebroadcasting the streaming media by rebroadcasting the streaming media to the at least one device using bandwidth associated with the wireless network and using third generation (3G) wireless communication technology.

In still further embodiments, the wireless network is further configured to rebroadcast the streaming media by rebroadcasting the streaming media to the at least one device using bandwidth associated with the wireless network and using wideband code division multiple access (WCDMA) technology, universal mobile telecommunications system (UMTS) technology, and/or enhanced data GSM (global system for mobile communications) environment technology.

In still further embodiments, the wireless network comprises a Wi-Fi communication network.

In still further embodiments, the wireless network is further configured to rebroadcast the streaming media by rebroadcasting the streaming media to the at least one device using bandwidth associated with the wireless network and using IEEE 802.11b technology.

In still further embodiments, the wireless network is further configured to rebroadcasting the streaming media by rebroadcasting the streaming media to the at least one device using bandwidth associated with the wireless network while moving the at least one device between cells associated with the wireless network.

In other embodiments, an article of manufacture for operating a communication network comprises a computer readable storage medium having computer readable program code embodied therein. The computer readable program code comprises computer readable program code configured to obtain a subscription at a wireless network from at least one device for a rebroadcast of streaming media and computer readable program code configured to rebroadcast the streaming media to the at least one device using the wireless network responsive to obtaining the subscription.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF EMBODIMENTS

Figure 1:
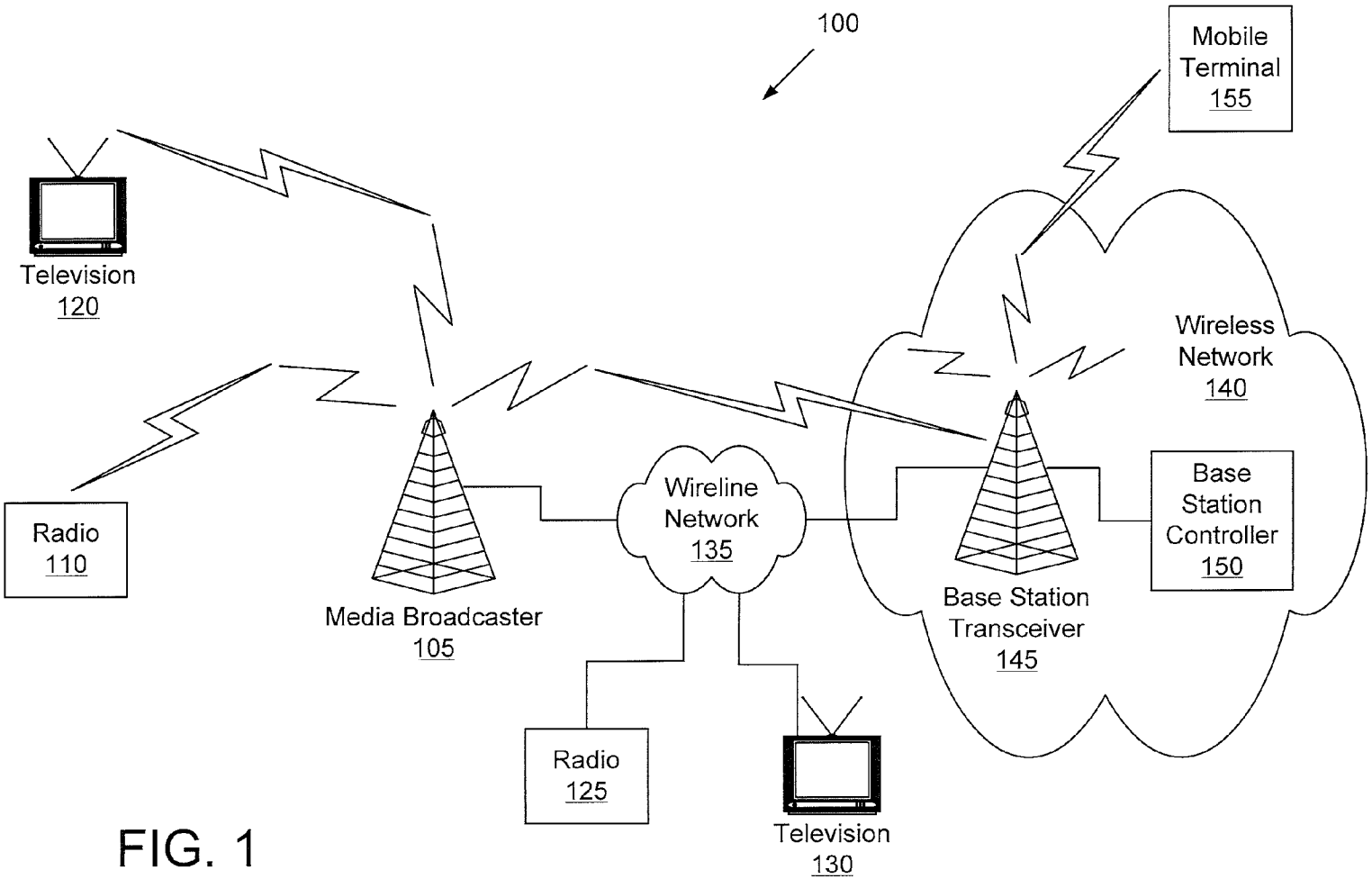
FIG. 1 is a schematic that illustrates a communication network that includes a wireless network in accordance with some embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

The present invention may be embodied as systems, methods, and/or computer program products. Accordingly, the present invention may be embodied in hardware and/or in software (including firmware, resident software, micro-code, etc.). Furthermore, the present invention may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Referring now to FIG. 1, an exemplary communication network 100, in accordance with some embodiments of the present invention, comprises a media broadcaster 105 that may broadcast streaming media content, such as, for example, amplitude modulation (AM) radio broadcasts, frequency modulation (FM) radio broadcasts, video conference broadcasts, gaming application broadcasts, Webinars, and the like to radios 110 and/or television sets 120 over an air interface, in accordance with some embodiments of the present invention. In other embodiments, the media broadcaster 105 may broadcast streaming media content as described above to radios 125 and television sets 130 over a wireline network 135, such as a cable network. As used herein, "streaming media" means a continuous supply of data, such as audio, video, and/or text data. The data may be supplied from a source location, such as the media broadcaster 105, to an end user. Streaming media may allow a user to listen to and/or view content instantly instead of requiring the user to download an entire file first before it may be listened to and/or viewed.

As shown in FIG. 1, the media broadcaster 105 may also provide the streaming media content discussed above to a wireless network 140 through a base station transceiver 145. In accordance with various embodiments of the present invention, the media broadcaster 105 may provide the streaming media content to the base station transceiver 145 using an air interface and/or using the wireline network 135.

The base station transceiver 145 communicates with one or more mobile terminals 155 via an air interface. The base station transceiver may be associated with a service "sector" and/or cell. As used herein, the term "mobile terminal" may include a cellular radiotelephone with or without a multi-line display; a Personal Communications System (PCS) terminal that may combine a cellular radiotelephone with data processing, facsimile and data communications capabilities; a personal digital assistant (PDA) that can include a radiotelephone, pager, Internet/intranet access, Web browser, organizer, calendar and/or a GPS receiver; and a conventional laptop and/or palmtop receiver or other appliance that includes a radiotelephone transceiver. Access terminals may also be referred to as "pervasive computing" devices.

Figure 2:
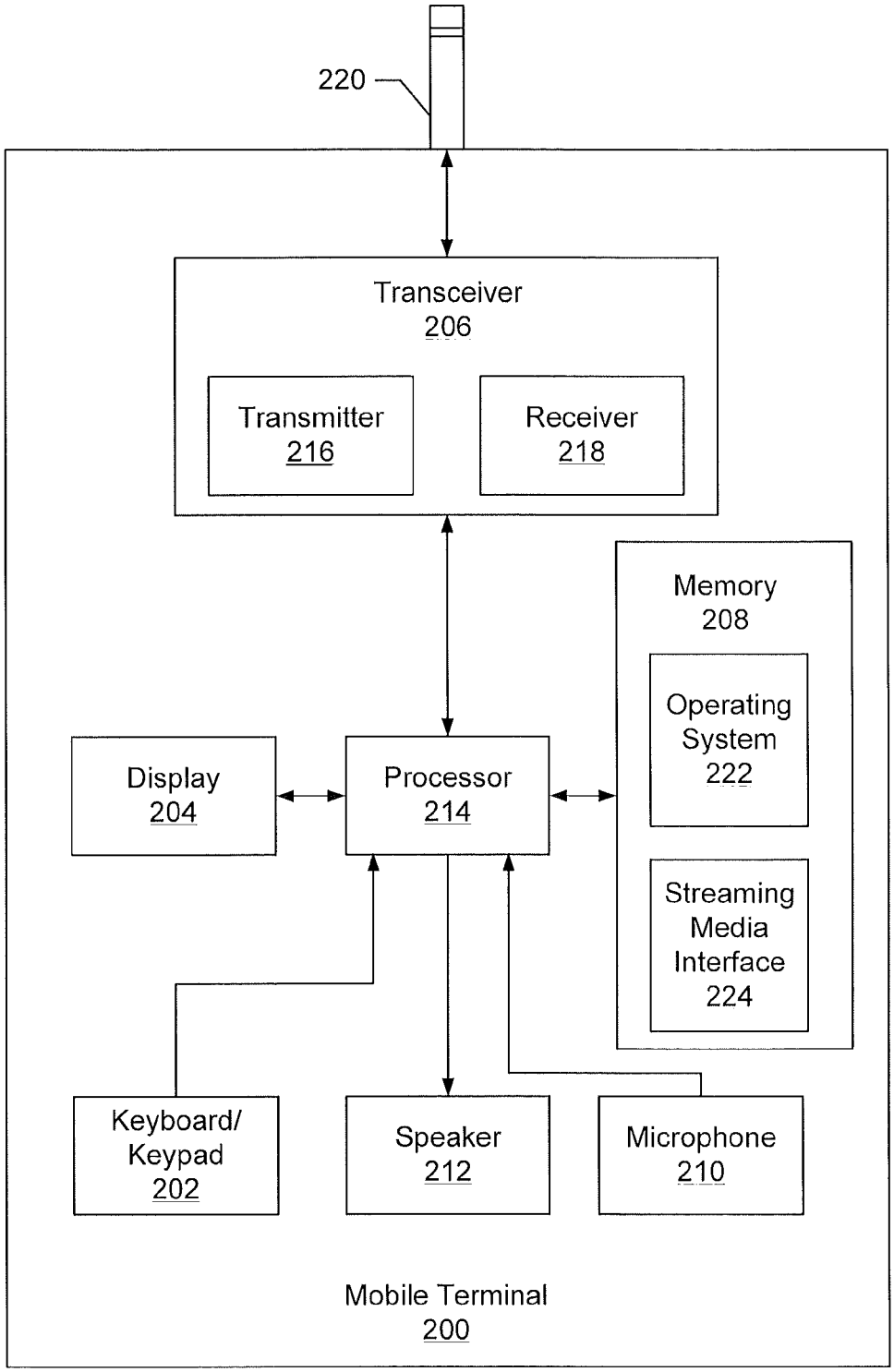
FIG. 2 is a block diagram that illustrates a mobile terminal in accordance with some embodiments of the present invention.

FIG. 2 illustrates a mobile terminal 200 that may be used in embodiments of the mobile terminal 155 of FIG. 1, in accordance with some embodiments of the present invention. The mobile terminal 200 comprises a keyboard/keypad 202, a display 204, a transceiver 206, a memory 208, a microphone 210, and a speaker 212 that communicate with a processor 214. The transceiver 206 typically comprises a transmitter circuit 216 and a receiver circuit 218, which cooperate to transmit and receive radio frequency signals to base station transceivers via an antenna 220. The radio frequency signals transmitted between the mobile terminal 200 and the base station transceivers may comprise both traffic and control signals (e.g., paging signals/messages for incoming calls), which are used to establish and maintain communication with another party or destination. The radio frequency signals may also comprise packet data information, such as, for example, cellular digital packet data (CDPD) information. The foregoing components of the mobile terminal 300 may be included in many conventional mobile terminals and their functionality is generally known to those skilled in the art.

The processor 214 communicates with the memory 208 via an address/data bus. The processor 214 may be, for example, a commercially available or custom microprocessor. The memory 208 is representative of the one or more memory devices containing the software and data used to operate the mobile terminal 200 and to facilitate reception of streaming media. The memory 208 may include, but is not limited to, the following types of devices: cache, ROM, PROM, EPROM, EEPROM, flash, SRAM, and DRAM.

As shown in FIG. 2, the memory 208 may contain up to two or more categories of software and/or data: the operating system 222 and the streaming media interface 224. The operating system 222 generally controls the operation of the mobile terminal 200. In particular, the operating system 222 may manage the mobile terminal's software and/or hardware resources and may coordinate execution of programs by the processor 214. The streaming media interface 224 may be configured to allow a user or consumer to subscribe at the wireless network 140 to one or more streaming media services that are obtained from the media broadcaster 105 and are rebroadcast by the wireless network 140. In addition, the streaming media interface 224 may be configured to tune into or select streaming media broadcasts provided through the wireless network 140.

Although FIG. 2 illustrates an exemplary software architecture that may be used to facilitate subscription to and reception of streaming media content in a mobile terminal, it will be understood that the present invention is not limited to such a configuration but is intended to encompass any configuration capable of carrying out the operations described herein.

Returning now to FIG. 1, the mobile terminal 155 communicates via the base station transceiver 145. As used herein, the term "communicate" means transmit, receive, and/or both transmit and receive. A function of the base station transceiver 145 is to handle radio communication with the mobile terminal 155. In this capacity, the base station transceiver 145 may function as a relay station for data and/or voice signals. Thus, the base station transceiver 145 may comprise a receiver and a transmitter. For purposes of illustration, only one base station transceiver 145 and one mobile terminal 155 are shown in FIG. 1. It will be understood, however, that the wireless network 140 may comprise hundreds of base station transceivers 145 respectively associated with hundreds of sectors or cells, and may serve thousands of mobile terminals. In addition to the base station transceiver 145, the wireless network 140 comprises a base station controller 150. The base station transceiver 145 also communicates with the base station controller 150. The base station controller 150 may comprise stored program control and processor resources for managing the wireless network 140.

To facilitate communication of streaming media content between the base station transceiver and one or more mobile terminals 155, the wireless network may use third generation (3G) wireless communication technology as the air interface between the base station transceiver 145 and the one or more mobile terminals 155. 3G is the name given to wireless network technology that may provide relatively high speed bandwidth to mobile terminals. Specifically, 3G networks support data rates of up to 2.05 Mbits/sec for stationary terminals, up to 384 Kbits/sec for slowly moving terminals, and up to 128 Kbits/sec for relatively fast moving devices, such as mobile terminals in moving vehicles.

In accordance with various embodiments of the present invention, the 3G wireless communication technology may be wideband code division multiple access (WCDMA) technology, universal mobile telecommunications system (UMTS) technology, and/or enhanced data global system for mobile communications (GSM) environment (EDGE) technology. WCDMA is based on the CDMA IS-95 standard and can support data rates of up to 2 Mbits/sec for local area access or 384 Kbits/sec for wide area access. UMTS also supports data rates of up to 2 Mbits/sec and also may provide broadband services to mobile terminals throughout the world using fixed, wireless, and/or satellite networks. EDGE is a faster version of the GSM wireless standard and may support data rates up to 384 Kbits/sec. In other embodiments of the present invention, the wireless network 140 may comprise a Wi-Fi communication network. Wi-Fi networks use radio communication technologies based on the IEEE 802.11b standard to provide data rates of up to 11 Mbits/sec.

Advantageously, the present invention may allow mobile terminals to receive streaming media content while allowing a user to remain free to move about and conduct his or her daily activities. That is, a user may carry a mobile terminal between cells or sectors associated with a wireless network while seamlessly listening to a streaming media broadcast delivered over the bandwidth associated with the wireless network. In accordance with various embodiments of the present invention, streaming media content that is delivered over the Internet could be rebroadcast to a mobile terminal through the bandwidth of the wireless network if the mobile terminal has the appropriate capabilities for displaying the streaming media content, e.g., video and/or audio capabilities.

Although FIG. 1 illustrates an exemplary communication network 100 architecture, it will be understood that the present invention is not limited to such a configuration, but is intended to encompass any configuration capable of carrying out the operations described herein.

Figure 3:
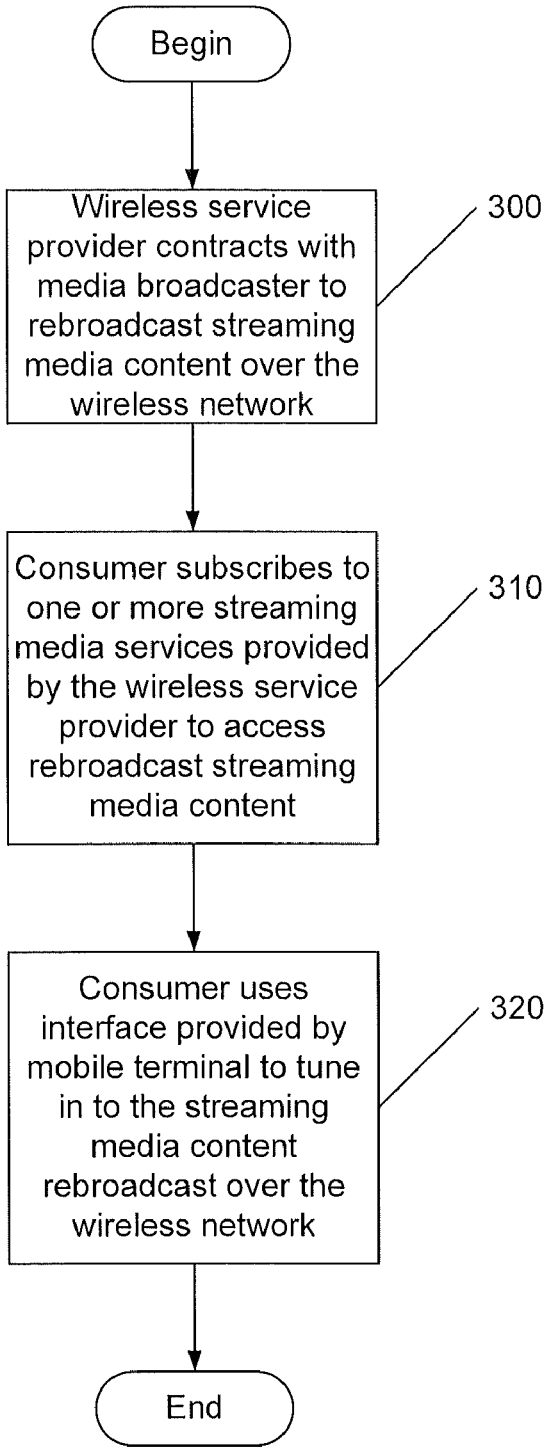
FIG. 3 is a flowchart that illustrates operations of a communication network in accordance with some embodiments of the present invention.

Referring now to FIG. 3, operations for providing streaming media content to a consumer through a mobile terminal, in accordance with some embodiments of the present invention, will now be described. Operations begin at block 300 where the wireless service provider contract with a media broadcaster to rebroadcast streaming media content over the service provider's wireless network, such as the wireless network 140 of FIG. 2. At block 310, the consumer subscribes to one or more streaming media services provided by the wireless service provider to gain access to the rebroadcast of the streaming media content. Once the consumer has subscribed to the streaming media service, the consumer may use an interface provided by a mobile terminal to tune in to the streaming media content that is rebroadcast over the wireless network. The mobile terminal may provide a menu to identify channels of content by station identification, call letters, AM or FM frequency, or other types of identifiers. The consumer may subscribe to a streaming media broadcast on a pay per view (PPV) basis or on a monthly subscription charge basis, in accordance with various embodiments of the present invention.

The flowchart of FIG. 3 illustrates the architecture, functionality, and operations of some embodiments of methods, systems, and computer program products for transmitting streaming media to a mobile terminal using the bandwidth associated with a wireless network. In this regard, each block represents a module, segment, or portion of code, which comprises one or more executable instructions for implementing the specified logical function(s). It should also be noted that in other implementations, the function(s) noted in the blocks may occur out of the order noted in FIG. 3. For example, two blocks shown in succession may, in fact, be executed substantially concurrently or the blocks may sometimes be executed in the reverse order, depending on the functionality involved.

Many variations and modifications can be made to the embodiments described herein without substantially departing from the principles of the present invention. All such variations and modifications are intended to be included herein within the scope of the present invention, as set forth in the following claims.

That which is claimed:

1. A method of operating a communication network, comprising:

obtaining a subscription from at least one device for a rebroadcast of streaming media; and rebroadcasting the streaming media via a base station transceiver to the at least one device responsive to obtaining the subscription;

obtaining authorization from a media broadcaster that provides the streaming media to rebroadcast the streaming media prior to rebroadcasting the streaming media.

2. The method of claim 1, wherein the streaming media comprises audio and video content.

3. The method of claim 1, wherein rebroadcasting the streaming media comprises:

rebroadcasting the streaming media to the at least one device using bandwidth associated with a wireless network and using third generation wireless communication technology.

4. The method of claim 1, wherein rebroadcasting the streaming media comprises:

rebroadcasting the streaming media to the at least one device using bandwidth associated with a wireless network and using wideband code division multiple access technology.

5. The method of claim 1, rebroadcasting the streaming media to the at least one device using bandwidth associated with a wireless network, wherein the wireless network comprises a Wi-Fi communication network.

6. The method of claim 1, wherein rebroadcasting the streaming media comprises:

rebroadcasting the streaming media to the at least one device using bandwidth associated with a wireless network and using IEEE 802.11b technology.

7. The method of claim 2, wherein the streaming media further comprises text.

8. The method of claim 2, wherein the streaming media comprises content from a television broadcast.

9. The method of claim 2, wherein the streaming media comprises content from a gaming application.

10. The method of claim 1, wherein rebroadcasting the streaming media comprises:

rebroadcasting the streaming media to the at least one device using bandwidth associated with a wireless network while moving the at least one device between cells associated with the wireless network.

11. A communication system, comprising:

a network that is configured to obtain a subscription from at least one device for a rebroadcast of streaming media and to rebroadcast the streaming media via a base station transceiver to the at least one device responsive to obtaining the subscription;

wherein the network is further configured to obtain authorization from a media broadcaster that provides the streaming media to rebroadcast the streaming media prior to rebroadcasting the streaming media.

12. The communication system of claim 11, wherein the streaming media comprises audio and video content.

13. The communication system of claim 11, wherein the network comprises a wireless network and is further configured to rebroadcast the streaming media by rebroadcasting the streaming media to the at least one device using bandwidth associated with the wireless network and using third generation wireless communication technology.

14. The communication system of claim 11, wherein the network comprises a wireless network and is further configured to rebroadcast the streaming media by rebroadcasting the streaming media to the at least one device using bandwidth associated with the wireless network and using wideband code division multiple access technology.

15. The communication system of claim 11, wherein the network comprises a Wi-Fi communication network.

16. The communication system of claim 15, wherein the network comprises a wireless network and is further configured to rebroadcast the streaming media by rebroadcasting the streaming media to the at least one device using bandwidth associated with the wireless network and using IEEE 802.11b technology.

17. The method of claim 11, wherein the network comprises a wireless network and is further configured to rebroadcast the streaming media by rebroadcasting the streaming media to the at least one device using bandwidth associated with the wireless network while moving the at least one device between cells associated with the wireless network.

18. An article of manufacture for operating a communication network comprising:

a non-transitory computer readable storage medium having computer readable program code embodied therein, the computer readable program code comprising:

computer readable program code configured to obtain a subscription from at least one device for a rebroadcast of streaming media; and computer readable program code configured to rebroadcast the streaming media via a base station transceiver to the at least one device responsive to obtaining the subscription;

obtaining authorization from a media broadcaster that provides the streaming media to rebroadcast the streaming media prior to rebroadcasting the streaming media.

* * * * *